US010051911B2

(12) United States Patent
Kupferberg

(10) Patent No.: US 10,051,911 B2
(45) Date of Patent: Aug. 21, 2018

(54) SHOE HAVING A PRINTED DESIGN AND PRINTING PROCESS FOR SHOES

(71) Applicant: Jono Anthony Kupferberg, Evanston, IL (US)

(72) Inventor: Jono Anthony Kupferberg, Evanston, IL (US)

( * ) Notice: Subject to any disclaimer, the term of this patent is extended or adjusted under 35 U.S.C. 154(b) by 0 days.

(21) Appl. No.: 15/657,955

(22) Filed: Jul. 24, 2017

(65) Prior Publication Data

US 2017/0332724 A1 Nov. 23, 2017

Related U.S. Application Data

(63) Continuation of application No. 14/160,728, filed on Jan. 22, 2014, now abandoned.

(60) Provisional application No. 61/755,743, filed on Jan. 23, 2013.

(51) Int. Cl.

| | |
|---|---|
| ***A43B 3/00*** | (2006.01) |
| ***A43D 8/22*** | (2006.01) |
| ***A43D 111/00*** | (2006.01) |
| ***A43B 9/00*** | (2006.01) |
| ***A43B 23/02*** | (2006.01) |

(52) U.S. Cl.

CPC ..... *A43B 3/0078* (2013.01); *A43B 9/00* (2013.01); *A43B 23/025* (2013.01); *A43D 8/22* (2013.01); *A43D 111/00* (2013.01)

(58) Field of Classification Search

CPC ..... A43B 3/0078; A43D 8/22; A43D 999/00
USPC ..... 12/142 R, 146 R, 146 C
See application file for complete search history.

(56) References Cited

U.S. PATENT DOCUMENTS

| | | | | | |
|---|---|---|---|---|---|
| 1,956,969 | A * | 5/1934 | Ayers | A43B 23/25 | 12/146 C |
| 2,018,510 | A * | 10/1935 | Brauer | A43B 23/025 | 12/146 CK |
| 2,034,091 | A * | 3/1936 | Dunbar | A43B 5/10 | 12/1 A |
| 2,049,175 | A * | 7/1936 | Regan | A43D 8/22 | 101/129 |
| 2,425,955 | A * | 8/1947 | Rouch | A43B 23/024 | 36/45 |
| 3,906,642 | A * | 9/1975 | Cohen | A43B 1/0027 | 36/112 |
| 5,345,638 | A * | 9/1994 | Nishida | A41H 3/08 | 12/146 C |
| 5,393,372 | A * | 2/1995 | Ammon | A43B 3/0078 | 156/242 |
| 6,957,504 | B2 * | 10/2005 | Morris | A43B 1/0027 | 36/1 |
| 7,051,460 | B2 * | 5/2006 | Orei | A43B 1/00 | 36/3 A |
| 7,089,691 | B1 * | 8/2006 | Silvera | A43B 3/0078 | 36/132 |

(Continued)

*Primary Examiner* — Marie Bays
(74) *Attorney, Agent, or Firm* — Gould & Ratner LLP

(57) ABSTRACT

The invention provides a method of assembling a shoe including a printed design for providing flat material having a first designated area and a second designated area, printing a first portion of the design on the first designated area and printing a second portion of the design on the second designated area, separating the designated areas into individual panels and assembling each panel, so that the first portion of the design joins the second portion of the design when each panel is arranged side by side to form an uninterrupted and complete design.

20 Claims, 3 Drawing Sheets

(56) References Cited

U.S. PATENT DOCUMENTS

| | | | | |
|---|---|---|---|---|
| 7,559,352 | B2 * | 7/2009 | Rodriguez | A61G 12/00 101/42 |
| 8,347,438 | B2 * | 1/2013 | Bell | A41D 27/24 12/146 C |
| 9,254,640 | B2 * | 2/2016 | Miller | A43B 3/0078 |
| 9,446,603 | B2 * | 9/2016 | Miller | A43B 3/0078 |
| 9,687,039 | B2 * | 6/2017 | Koyess | A43B 1/0027 |
| 2011/0083787 | A1 * | 4/2011 | Henry | A41D 27/245 156/64 |
| 2014/0352173 | A1 * | 12/2014 | Bell | A43B 1/04 36/50.1 |

* cited by examiner

SHOE HAVING A PRINTED DESIGN AND PRINTING PROCESS FOR SHOES

This application is a continuation application and claims priority from co-pending U.S. patent application Ser. No. 14/160,728 filed Jan. 22, 2014, that is a continuation of U.S. application Ser. No. 61/755,743 filed on Jan. 23, 2013, the entirety of each which is hereby incorporated by reference.

The present invention pertains to a printing process for shoes, an assembly process for shoes and shoes having a printed design.

BACKGROUND

Providing designs or logos on shoes such as athletic shoes or sneakers is usually accomplished by using flimsy canvas material. In particular a printing process is used to adhere a design or logo to the shoe across panels of the shoe following the assembly and stitching together of each of the panels. This type of process leads to poor quality of the logo and cumbersome printing processes on surfaces that are not flat and difficult to adjust for different sizes. The present invention solves such disadvantages of previous printing processes.

SUMMARY

The present invention provides a method of providing a design on a shoe comprising the steps of providing a piece of leather with the individual panels outlined on the surface of the piece of material and is entirely positioned under the printer, the print design is applied once to the different panels outlined on the surface and the panel encompasses all elements of the designs (i.e., even the sections that are simply one color are printed on at this stage in order to maximize the efforts of one single print) the panels are then cut out and removed from the later piece and the panels are stitched together on the shoe and are lined up in such a way that yields the result of an intact uninterrupted logo/design.

In alternative embodiments, depending on how cost effective the manufacturer wants to be, the prints can be broken up into multiple stages. In other words, while the goal is to execute one print for the designs of both shoes (both the left and right foot) the manufacturer could execute one print for the left foot, and a separate one all together for the right. This stage of the process could even be more meticulously accomplished wherein the manufacturer could undertake one print for each panel of the shoe.

In an embodiment a method of assembling a shoe including a printed design is provided that comprises the steps of providing a flat material having a first designated area outlining one panel and a second designated area that outlines a second panel, printing a first portion of the design on the first designated area and printing a second portion of the design on the second designated area, separating the designated areas into individual panels and assembling each panel so that the first portion of the design joins the second portion of the design when each panel is arranged side by side to form an uninterrupted and complete design. In an embodiment the designated areas may be located on a single sheet of material prior to separation into separate panels.

In an embodiment the flat material may include more than two designated areas and more than two portions of the design are printed across multiple designated areas and multiple panels. In an embodiment a seam is provided on a panel and no printing occurs at the seam. In an embodiment upon assembly of the panels the seam is covered by an edge of the adjacent panel and the design is uninterrupted across the paired panels. In an embodiment the flat material is one of leather and synthetic material. In an embodiment the printing is one of digital printing, screen printing, sublimation, ink jet printing, cold peel transfer, hot peel transfer and fabric dying. In an embodiment the designated areas may encompass the entire panel thereon.

The present invention also provides for a shoe having a design comprising multiple panels arranged and connected to form a shoe upper, a first portion of a design printed on a first panel, a second portion of a design printed on a second panel, the first panel having a seam formed at an edge, a first designated area provided on the first panel adjacent to the seam and terminating at the seam at a termination line running parallel and adjacent to the edge of the first panel. The first portion of the design may be printed at the designated area extending at least up to the termination line. The second panel may have a second designated area terminating at a termination edge of the material and the first portion of the design abuts the second portion of the design where the termination line abuts the termination edge in order to form a continuous, uninterrupted design. In an embodiment the first portion of the design is printed so that no portion of the design is present on the seam and all printing terminates at the termination line.

In an embodiment the first portion of the design is printed so that a portion of the design is present on the seam, but the portion printed on the seam is identical to at least a part of the second portion of the design at the termination edge of the second panel. In an embodiment the contiguous uninterrupted design extends across two panels. In an embodiment the contiguous, uninterrupted design extends across more than two panels. In an embodiment the uninterrupted design is contained within the first panel.

Figure 1:
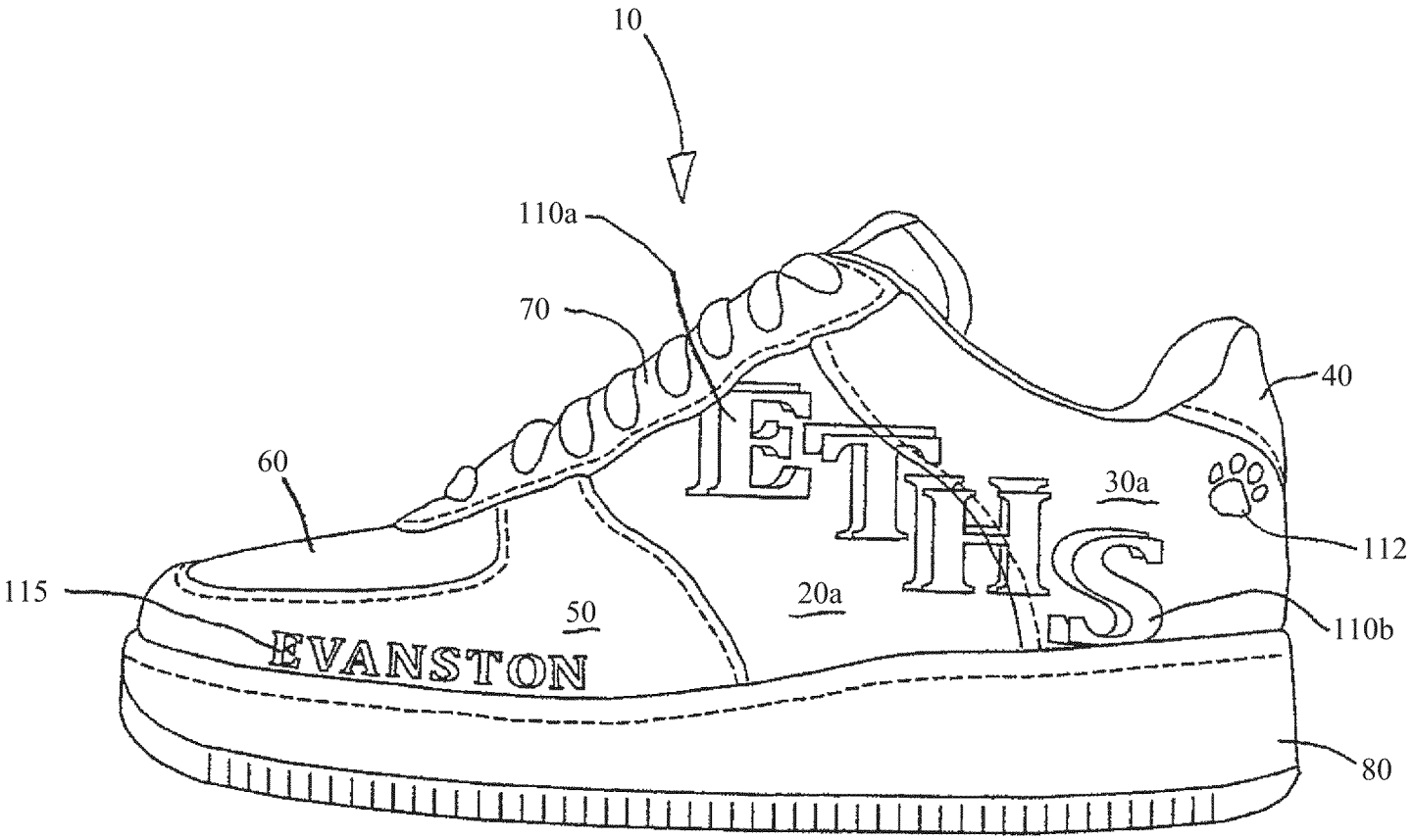
FIG. 1 is a side elevation view of an assembled shoe of the present invention.

While the invention is amendable to various modifications and alternate forms, specific embodiments have been shown by way of example in the drawings and will be described in detail below. It should be understood that the intention is not to limit the invention to the particular embodiments depicted in the drawing figures. The intention is to cover all modifications, equivalents and alternatives falling within the spirit and the scope of the invention.

DETAILED DESCRIPTION

FIGS. 1-10 depict a printing and assembly process for shoes. FIG. 1 is an assembled view of the shoe 10 depicting each of the panels of the shoe stitched together and with the logos/designs arranged appropriately so that they are contiguous across the panels of the shoe. The shoe includes side panels 20*a,b*, rear upper panels 30*a,b*, heel panel 40, toe panel 50, central toe panel 60, lace upper 70, sole 80 and deigns 110*a,b*, 112 and 115.

FIGS. 2-8 depict the panels of the shoe separated prior to assembly of the shoe as depicted in FIG. 1. In an embodiment, the panels may be made from leather or other man-made or synthetic material. Each of the panels 20-70 depicted in FIGS. 2-8 are shown lying flat on a surface so that they may be easily printed on with logos or other designs. The panels may be decorated using multi-layered digital printing, screen printing, sublimation, ink jet printing, cold and hot peel transfers or fabric dying. In an embodiment the panels 20-70 are cut from a single piece of material. Prior to cutting and removing the panels the printing process may be undertaken on the entire flat material so that a portion of each printed design is placed in the predetermined designated area. In an alternate embodiment, the printing process may occur following cutting and removal of the panels form the entire sheet.

Figures 2, 3, 4, 5, 6, 7, 8:
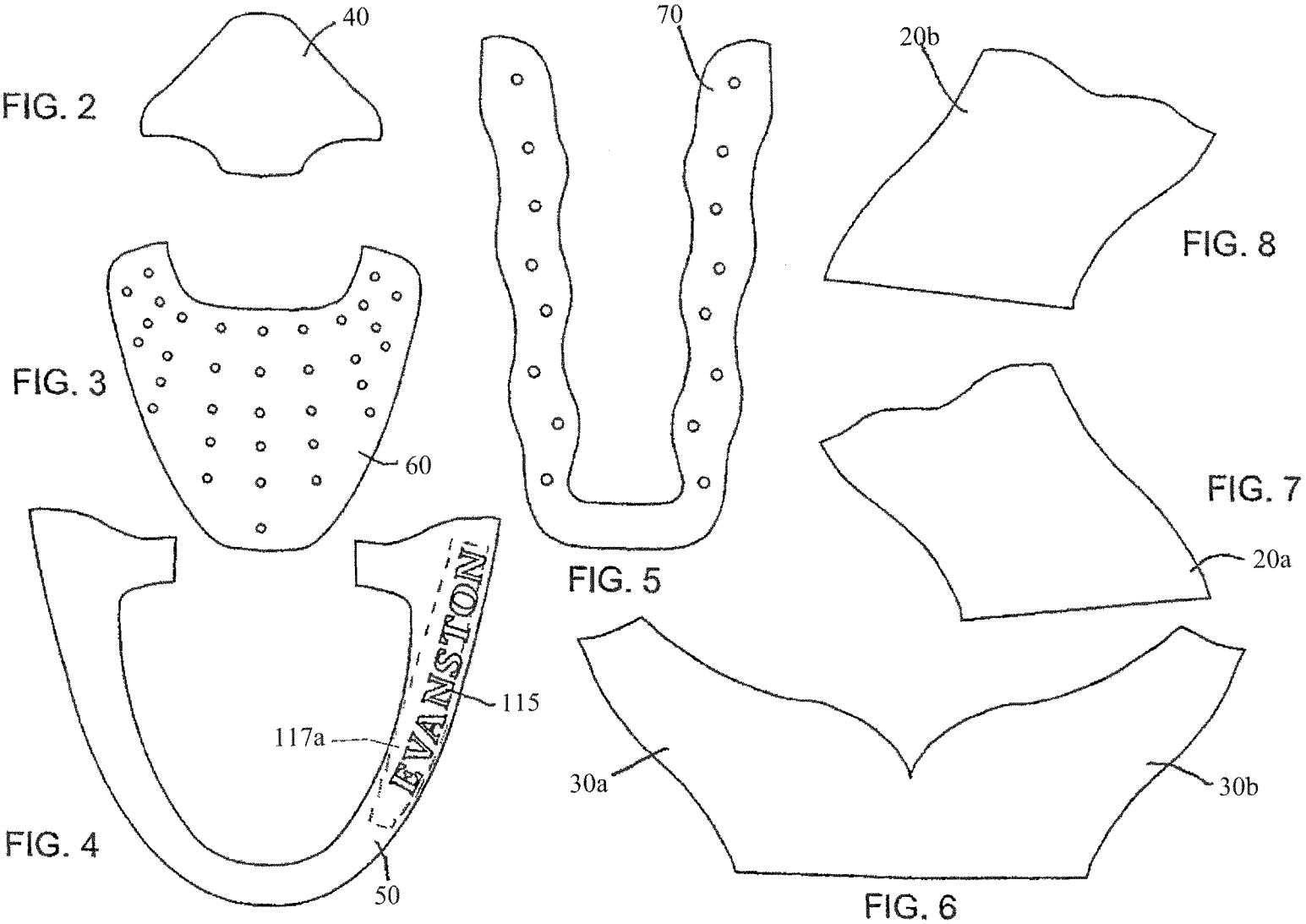
FIGS. 2-8 are plan views of individual panels of a shoe of the present invention.

FIG. 2 depicts heel panel 40. FIG. 3 depicts central toe panel 60. FIG. 4 depicts toe panel 50. FIG. 5 depicts lace upper 70. FIG. 6 depicts rear upper 30*a*, 30*b*. FIG. 7 depicts side panel 20*a*. FIG. 8 depicts side panel 20*b*.

FIG. 4 depicts the toe panel 50 having logo 115 printed at the first designated area 117*a*. In an embodiment, the letters that spell "EVANSTON" have been adhered to the panel 50 using a screen printing process. As the toe panel 50 is lying flat, the screen printing process may be accomplished easily and allow for the printing to adhere properly for long lasting duration of the screen printed letters.

FIGS. 7 and 8 depict side panels 20*a*, 20*b*. It may be understood that panel 20*a* resides on the left side of the shoe as shown in FIG. 1 and panel 20*b* resides on the right side of the shoe which is out of sight in FIG. 1. Panel 20*a*, as shown in FIG. 7, has no design added thereto and is a blank panel. Likewise, FIG. 6 depicts rear panel 30*a*, 30*b*. It may be understood that the panels wrap around the shoe so that the left portion 30*a* wraps around the left side of the shoe as depicted in FIG. 1 and portion 30*b* wraps around the right side of the shoe and is out of sight in FIG. 1.

Figure 9:
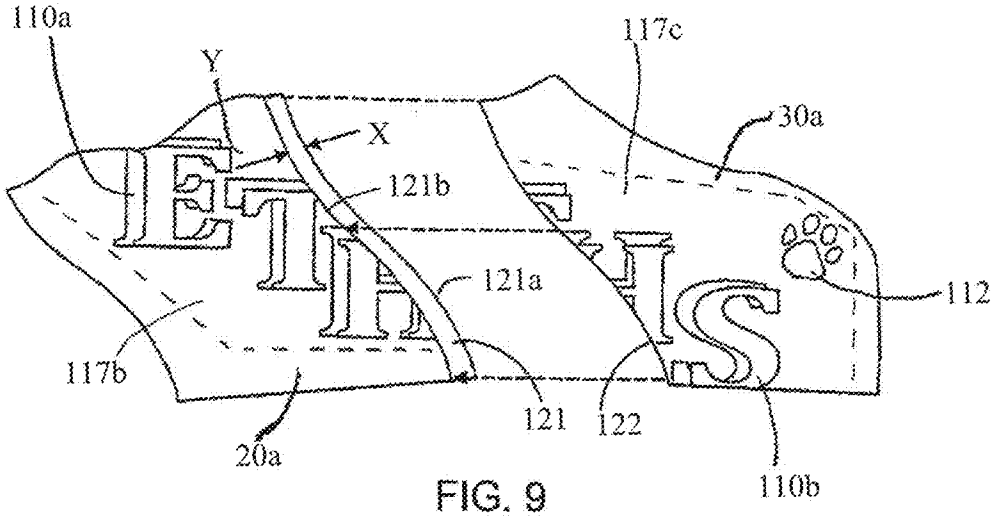
FIGS. 9-10 are plan views of paired panels being assembled depicting an assembly step of the present invention.

Turning to FIG. 9, the center panel 20*a* is depicted on the left and rear panel 30*a* is depicted on the right. FIG. 9 depicts these panels 20*a*, 30*a* after having the logo indicia 110*a*, 110*b* printed on each individual panel in the second and third designated areas 117*b*, 117*c*. In this example, the entire logo when put together will read "ETHS" (Evanston Township High School) in an uninterrupted manner. As the logo extends across multiple panels 20*a*, 30*a*, the printing of the logos occurs separately on each panel. For example, the letters "ET" are printed partially on panel 20*a* in the second designated area 117*b*. The other portions of the letters "THS" are printed on panel 30*a* in the third designated area 117*c*. Although in this example, the logo is comprised of alphanumeric symbols, other types of logos, such as animal caricatures or other designs, may be used on the panels. For example, the rear panel 30*a* also includes an additional logo in the form of an animal footprint 112 included in third designated area 117*c*. But in a similar fashion, those images, designs or indicia will be separated between the first panel 20*a* and second panel 30*a*, prior to joining the two panels together to form the completed, uninterrupted image or logo.

It is understood that the above processes provide for a printing process that occurs on panels of the shoe in a flat orientation to allow for easier printing and higher quality images. The present invention solves such disadvantages of previous printing processes.

The printing of the logo 110*a* on panel 20*a* accounts for the provision of a seam (non-printed area) 121, so that no logo appears on the seam that will be placed under the second panel 30*a*. The area between arrows x and y comprises the seam or border area 121. In an embodiment the width of the seam between points x and y may be 1 inch to 1132 inch. In an embodiment, the blank areas on any portion of the panels including the seam 121, could be any other color/design that can be overlapping. For example, the seam area 121 could be black or other color or a pattern, instead of being blank. Further, the design can be permitted to run into the seam area, but the overlapping edge from the adjacent panel will compensate for the overlap of the seam on top of the design.

Figure 10:
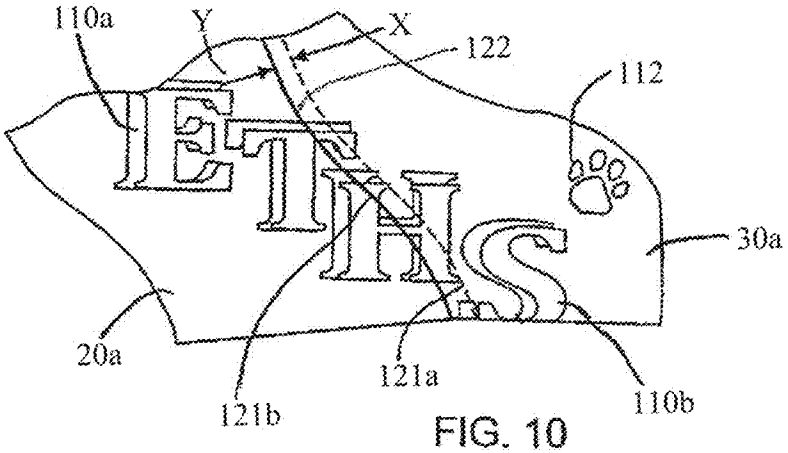

Turning to FIG. 10, the panels 20*a* and 30*a* are shown stitched or adhered together. It can be seen that the seam 121 is covered by the edge 122 of the rear panel 30*a* and the area between the arrows x-y is covered by the edge of the rear panel 30*a*. By joining the panels 20*a*, 30*a* in such a manner, the entire logo 110*a, b* is depicted in a uniform uninterrupted and combined manner, so that its proper form is depicted on the assembled shoe (also as shown in FIG. 1). By assembling the shoe in this fashion, it can be understood that the printing of the shoe panels can be accomplished easily and quickly while the panels are in a flattened state (either as separated panels or a single piece of material). Designs are easily adjusted for different sizes. Upon assembly of the shoe using normal assembly procedures, the shoe can be inexpensively ornamented with designs and logos that enhance the attractiveness of the shoe In an embodiment the shoe 10 includes multiple panels arranged and connected to form a shoe upper. Turning to FIG. 9, a first portion of a design is printed on a first panel 110*a*. A second portion of a design is printed on a second panel 110*b*. The first panel has a seam 121 formed at an edge 121*a*. A first designated area is provided on the first panel 20*a* adjacent the seam 121 and terminates at the seam at a termination line 121*b*. The first portion of the design is printed in the first designated area 117*b* extending at least up to the termination line 121*b*. The second panel 30*a* has a second designated area 117*c* terminating at a termination edge 122 of the material. The first portion of the design 110*a* abuts the second portion of the design 110*b* where the termination line abuts the termination edge 122 in order to form a continuous, uninterrupted design (FIG. 10). The first portion of the design 117*b* is printed so that no portion of the design is present on the seam 121 and all printing terminates at the termination line 121*b*.

It is understood that while the above description was with respect to side panel 20*a* and rear panel 30*a*, the same procedure could be undertaken for each of the panels of the shoe, so that the entire shoe may have a logo covering the entire expanse of the surfaces on the shoe while the printing is done on each individual panel (or a single piece of material prior to separating into multiple panels) in a coordinated fashion, so that when the panels are assembled, the logo or design fits together as an uninterrupted whole.

In some embodiments, the process may only merge two panels to construct a complete design/logo. However, the process can in fact be used to provide a complete design over more than two panels and designated areas. In an embodiment a complete design may span for example three panels of the side of the shoe. Further a design or logo may be a uniform color or pattern applied to the panels of the shoe, in some embodiments.

It will be apparent to those skilled in the art that various modifications and variations can be made for the present invention without departing from the spirit or scope of the invention. Thus, it is intended that embodiments of the invention cover the modifications and variations of this invention provided within the scope of the appended claims and their equivalents.

I claim:

1. A method of assembling a shoe including a printed design comprising the steps of:

providing flat material having a first designated area and a second designated area;

printing a first portion of the design on the first designated area and printing a second portion of the design on the second designated area;

separating the designated areas into individual panels; and assembling each panel, so that the first portion of the design joins the second portion of the design when each panel is arranged side by side to form an uninterrupted and complete design.

2. The method of claim 1 wherein prior to the printing step the designated areas are provided by separated panels.

3. The method of claim 1 wherein the designated areas are located on a single sheet of material prior to separation into separated panels.

4. The method of claim 1 wherein the flat material includes more than two designated areas and more than two portions of the design are printed across multiple designated areas and multiple panels.

5. The method of claim 1 wherein a seam is provided on a panel and no printing occurs at the seam.

6. The method of claim 5 wherein upon assembly of the panels the seam is covered by an edge of the adjacent panel and the design is uninterrupted across the paired panels.

7. The method of claim 1 wherein the flat material is one of leather and synthetic material.

8. The method of claim 1 wherein the printing is one of digital printing, screen printing, sublimation, ink jet print, cold peel transfer, hot peel transfer and fabric dying.

9. The method of claim 1 wherein designated areas encompass the entire panel thereon.

10. A method of assembling a shoe including a printed design comprising the steps of:

providing flat material having a first designated area outlining a first panel and a second designated area outlining a second panel;

printing a first portion of the design on the first designated area and printing a second portion of the design on the second designated area; and assembling each panel, so that the first portion of the design joins the second portion of the design when each panel is arranged side by side to form an uninterrupted and complete design.

11. The method of claim 10 wherein prior to the printing step the designated areas are provided by separated panels.

12. The method of claim 10 wherein prior to the printing step the designated areas are provided by separated panels.

13. The method of claim 10 wherein the designated areas are located on a single sheet of material prior to separation into separated panels.

14. The method of claim 10 wherein the flat material includes more than two designated areas and more than two portions of the design are printed across multiple designated areas and multiple panels.

15. The method of claim 10 wherein a seam is provided on a panel and no printing occurs at the seam.

16. The method of claim 10 wherein upon assembly of the panels the seam is covered by an edge of the adjacent panel and the design is uninterrupted across the paired panels.

17. The method of claim 10 wherein the flat material is one of leather and synthetic material.

18. The method of claim 10 wherein the printing is one of digital printing, screen printing, sublimation, ink jet print, cold peel transfer, hot peel transfer and fabric dying.

19. The method of claim 10 wherein designated areas encompass the entire panel thereon.

20. The method of claim 10 wherein the designated areas are separated into individual panels.

* * * * *